United States Patent [19]

Thiem

[11] Patent Number: 5,031,363

[45] Date of Patent: Jul. 16, 1991

[54] HAND HELD NON-DIRECTIONAL DISC BRAKE ROTOR FINISHING DEVICE

[76] Inventor: Eugene G. Thiem, P.O. Box 8439, Hobe Sound, Fla. 33455

[21] Appl. No.: 566,124

[22] Filed: Aug. 10, 1990

[51] Int. Cl.[5] ..... B24B 23/02; B24B 1/00

[52] U.S. Cl. ..... 51/170 T; 51/132; 51/281 SF; 51/259

[58] Field of Search ..... 51/170 R, 170 T, 179, 51/281 SF, 281 R, 259, 131.1, 131.3, 132, DIG. 3; 82/112

[56] References Cited

U.S. PATENT DOCUMENTS 3,500,589 3/1970 Ellege ..... 82/112

4,226,146 10/1980 Ekman ..... 82/112

4,361,988 12/1982 Gramlich ..... 51/281 SF

*Primary Examiner*—Roscoe V. Parker

*Attorney, Agent, or Firm*—Hedman, Gibson, Costigan & Hoare

[57] ABSTRACT

A hand held device for creating a non-directional finish on a rotating disc, such as a disc brake rotor, comprising a drive roller, attached to a drive shaft, intermediate finishing discs having finishing surfaces thereon and a handle on each side of said roller. The handles have bearings therein on which the drive shaft rotates. The device is also capable of disassembly to replace the finishing surfaces when necessary.

23 Claims, 2 Drawing Sheets

HAND HELD NON-DIRECTIONAL DISC BRAKE ROTOR FINISHING DEVICE

FIELD OF THE INVENTION

The present invention relates to a device for creating a non-directional finish on the surfaces of rotating objects, especially disc brake rotors.

BACKGROUND OF THE INVENTION

When repairing disc brakes and replacing brake pads it is generally preferred to cut the friction surface of the rotor to create a smooth finish, eliminating scratches and grooves which impair braking efficiency, and true the rotor. The rotor is normally cut by placing the rotor on a brake rotor lathe, which turns the rotor at high speeds, and running a cutting tool across the friction surface of the rotor to create an even cut with very close tolerances. Similarly, U.S. Pat. No. 4,226,146 refers to a lathe which can be used to cut a rotor without removing the rotor from the vehicle.

After the brake surface of the rotor is cut it is desirable to create a non-directional finish on the friction surface to improve friction between the brake pad and the surface. Also, it is at times preferable to place a finish on the friction surfaces of a rotor when it has not been cut to improve braking.

Generally, a finish is placed on the friction surface by hand sanding the surface with a fine or medium grit sand or emery paper or using a mechanical sander about the circular rotor friction surface. The procedure must be carried out on each side of the rotor separately.

An example of a mechanical grinder for use with brake rotors is found in U.S. Pat. No. 3,500,589. U.S. Pat. No. 3,500,589 refers to a device mounted to a brake lathe that is brought into engagement with the two opposed surfaces separately by manually removing the grinding disc from one side of the mount and replacing it on the other side of the mount to finish the other surface. Also, moving the tool carriage is required to engage the surfaces. This, however, beyond requiring time consuming steps, leaves the mount in place even when not in use, interfering with the use of the lathe for cutting the rotor.

Therefore, it is an object of the present invention to provide a quick and efficient non-directional finish to the friction surface on both sides of a brake rotor, after cutting, while the rotor is spinning either on a brake rotor lathe or on the vehicle.

It is a further object of this invention to provide such a finish with a device that does not require an external power source.

It is yet another object of the present invention to provide a device for creating a non-directional finish on a brake rotor which is hand held and can be used on rotors spinning either on a rotor lathe or on the vehicle and can be easily stored or transported.

It is another object of the invention to provide a rotor finishing device with replaceable finishing surfaces which needs little if any maintenance.

SUMMARY OF THE INVENTION

These and other objects are achieved through the use of a hand held finishing device for creating a non-directional finish on the friction surfaces of a rotating disc such as a disc brake rotor comprising a rotatable drive roller intermediate rotatable finishing discs, having finishing surfaces thereon, and handle means wherein when the drive roller engages the periphery of a spinning disc brake rotor, the finishing surfaces rotate across the rotation of the friction surfaces.

The finishing surfaces are normally replaceable sanding discs so that a new finishing surface can be attached when a used finishing surface no longer performs its required function. In its preferred embodiment, one of the finishing discs and associated finishing surface is of a larger diameter than the other to permit the device to be used on a disc brake rotor having a hub on one side. The smaller diameter disc would then be used on the side of the rotor with the hub having a smaller friction surface.

A drive shaft associated with the drive roller and finishing discs preferably rides on bearings and extends the length of the device within the handle means, to provide additonal security, stability and control of the rotating finishing discs. The drive shaft is threaded on at least one end and is engaged by a securing nut, to allow for disassembly of the device, to change the finishing surfaces, etc.

The device requires no external power source, being powered solely by engagement of the drive roller with the periphery of the spinning brake rotor.

The device preferably includes hand shields associated with the handle means as a safety feature to avoid accidents including the user unintentionally touching the rotating finishing discs during use. End caps or covers are also preferably included to cover the ends of the handle means to avoid inadvertant contact with the spinning drive shaft and securing nut located therein.

BRIEF DESCRIPTION OF THE DRAWINGS

The present invention will be better understood when reviewed with reference to the attached drawings, in which like reference characters indicate like parts. The drawings, however, are not intended to limit the invention in any manner whatsoever, wherein.

DETAILED DESCRIPTION OF THE PREFERRED EMBODIMENT

Figure 1:
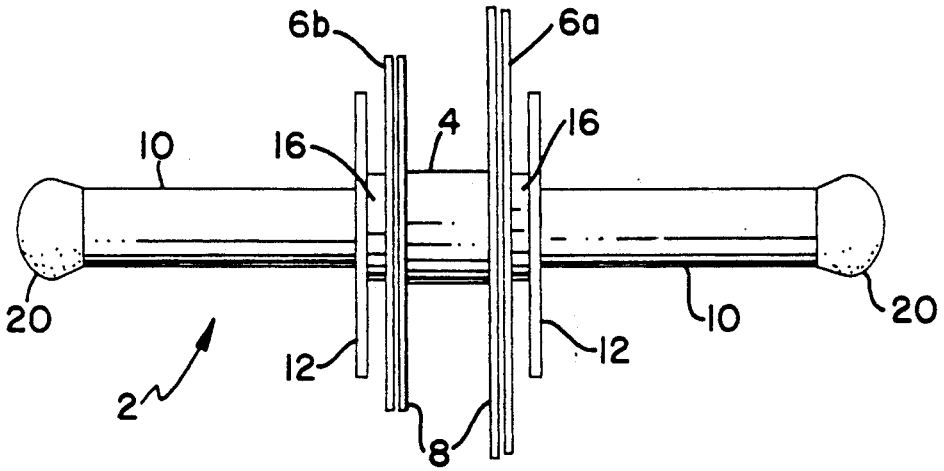
FIG. 1 is a front plan view of the hand held finishing device of the present invention.
Figure 2:
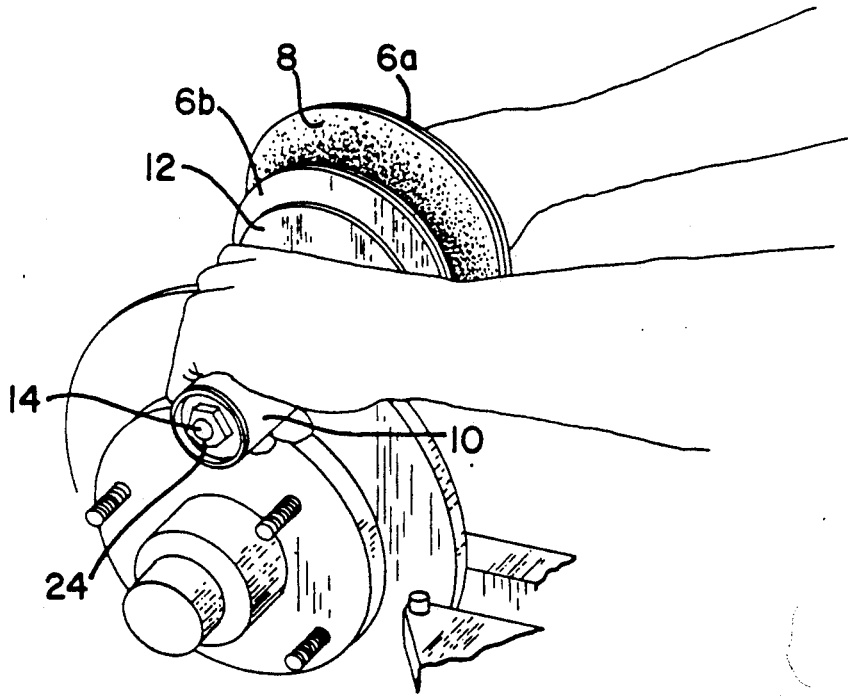
FIG. 2 is a perspective view of the device of the present invention in its operational position.

With reference to the FIGURES, and specifically FIG. 1, the device 2 of the present invention comprises a drive roller 4, associated with finishing discs 6 having finishing surfaces 8 thereon, and handle means 10. The handle means 10 include hand shields 12 to prevent accidents caused by contact with finishing discs 6 rotating at high speeds during use.

Figure 3:
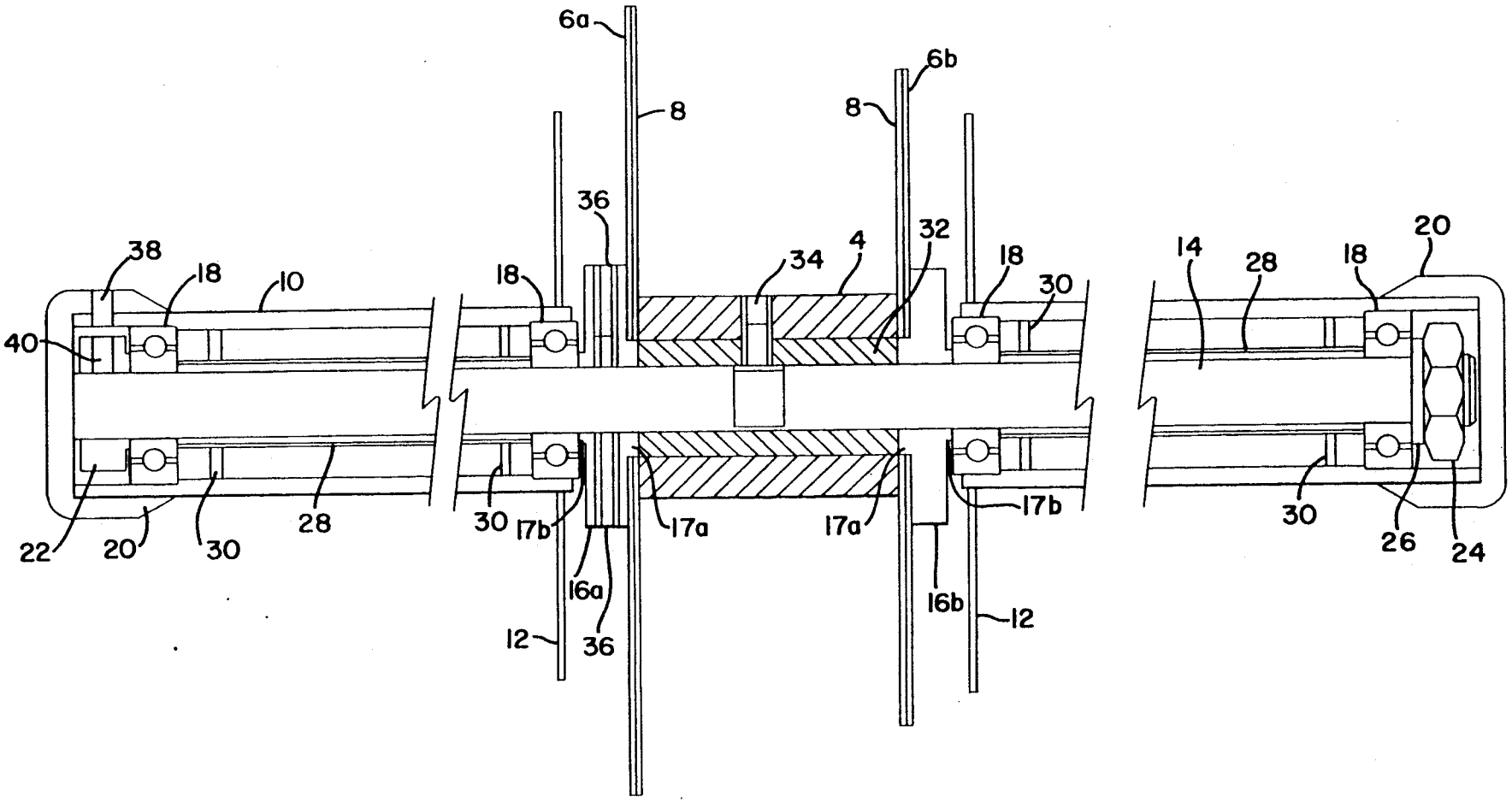
FIG. 3 is a plan view of the device in cross section.

As shown in FIG. 3, the drive roller 4 and finishing discs 6 are engaged by a drive shaft 14 which extends the length of the device 2, through hollow handle means 10, to about the ends of the handle means 10. A drive shaft 14 having a length substantially equal to the length of the device 2 is preferred to increase structural strength and improve stability and control when the drive shaft 14 is rotating at high speeds.

The drive shaft 14 is preferably a one-piece member that runs the length of the device 2 and is preferably a ½ to 1 inch diameter rod made of steel, aluminum or even a resin or fiber impregnated resin. The drive shaft 14 has a collar 22 permanently attached on one end, by welding, bolting, etc., and a threaded portion engaged by a securing nut 24 over a washer 26 at the other end. Rotation of the drive shaft 14 within the handle means 10 is enhanced by the use of sealed bearings 18 pressed within the handle means 10.

The bearings 18 can be ball or pin bearings and two sets are preferred for each handle means 10, i.e. two sets within the handle means 10 located to the right of the roller 4 and two sets on the handle means 10 located to the left of the roller 4. Within each handle means 10, one set of bearings 18 are preferably in proximity to the hand shield 12 and the other set of bearings 18 are in proximity to the end of the drive shaft 14.

The two sets of bearings 18 within each side of the handle means 10 are held in place by a bearing spacer 28, preferably comprising rigid tubing which surrounds the drive shaft 14. The bearing spacer 28 is retained within the handle means 10 by retainers 30 which preferably comprise rubber washers.

The drive roller 4 is preferably made of a hard rubber or polyurethate over an aluminum mandrel 32. The rubber or polyurethane may or may not be adhered to the mandrel 32. The roller 4 is removably attached to the drive shaft 14 to prohibit slippage of the roller 4 on the shaft 14 by keyed means between the roller 4 and the shaft 14 or, preferably, by a set screw 34 passing through the roller 4 and engaging the drive shaft 14. The set screw 34 is preferably an Allen head screw set flush or recessed within the drive roller 4.

The finishing discs 6 are preferably made of phenolic backing plates approximately 0.060 inches thick. The radius of the finishing discs 6 beyond the radius of the drive roller 4 is preferably at least the width of the friction surface on the rotor to create a finish across the entire friction surface. For use with disc brake rotors, the diameter of the discs 6 are preferably different for the discs 6 on each side of the roller 4 to accommodate the rotor hub. The disc 6 to be used on the hub side of the rotor is about five (5) inches in diameter and the disc 6 to be used on the other side is about six (6) inches in diameter.

The finishing surfaces 8 are generally sanding discs comprising aluminum oxide discs, being approximately 0.0060 inches thick, with a 24 to 36 grit surface. The diameter of the finishing surfaces 8 are approximately equal to or slightly greater in diameter than the finishing disc 6 to which they relate. The finishing surfaces 8 are attached to the finishing discs 6 by any means including direct pressure, adhesives, hook and loop fastening systems such as VELCRO, snaps and holes aligning with shear pins, bolts, etc. from the finishing discs 6 to the drive roller 4.

A spacer 16 is placed between the inner bearings 18 and the finishing disc 6 on each side of the roller 4 to maintain pressure between the components while allowing freedom of rotation between the rotating and stationary elements. Each spacer 16 has an inner boss **17*a* and an outer boss 17*b*** on the respective sides.

The inner boss **17*a* is preferably $\frac{7}{8}$ inch in diameter, relating to a standard $\frac{7}{8}$ inch hole in the aluminum oxide finishing surfaces 8 and phenolic finishing discs 6 used herewith. The inner boss 17*a* protrudes from the spacer 16 a height less than the combined thickness of the disc 6 and finishing surface 8. The inner boss 17*a* is not as thick as the combined finishing disc 6 and finishing surface 8 so that it does not contact the roller 4 when compressed, allowing the spacer 16 to contact only the finishing disc 6, the finishing disc 6 to contact the finishing surface 8, and the finishing surface 8 to contact the roller 4. This arrangement provides that the components will be in secure engagement when the device 2 is tightened, limiting slippage of the finishing surface 8** when in contact with the rotor.

The outer boss **17*b* is preferably of smaller diameter to contact the outer race of the inner bearings 18, which bearings 18 extend slightly beyond the handle 10 closest to the roller 4, to allow free rotation of the spacers 16 and the components therebetween. The thickness of the outer boss 17*b* is not essential since it is in direct contact with the inner bearings 18**.

The spacer 16 on the side of the device 2 on which the drive shaft 14 has a collar 22 rather than a removable nut 24 has two oppositely aligned set screws 36 to hold the spacer **16*a* in place. The set screws 36 act to retain the components between the spacer 16*a* and collar 22 when the device 2 is taken apart to change the finishing surfaces 30. Set screws 36 are used rather than a non-removable attachment such as welding to provide access to the internal components, i.e. when an internal bearing 18 is spun. The set screws 36 are tightened, to ensure proper placement of the spacer 16*a*, only after the device 2 has been tightened in its operational configuration by tightening the securing nut 24**.

End caps 20 are preferably placed over the ends of the handle means 10, including the securing nut 15 and collar 22, to prevent chips and dust from fouling the interior components. The caps 20 further provide a safety feature, prohibiting the user from inadvertantly contacting the rotating collar 22 or drive shaft 14 and securing nut 24 thereon.

In the preferred embodiment the finishing surfaces 8 are held in place with slippage on the disc 6 prohibited by direct pressure between the rotating components. The securing nut 24 is tightened on the threaded end of the drive shaft 14 to securely compress the outer and inner bearings 18 against the bearing spacers 28, the inner bearings 18 against the spacers 16, the spacer 16 against the finishing discs 6, the finishing discs 6 against the finishing surfaces 8, and the finishing surfaces 8 against the drive roller 4. On the other end of the drive shaft 14 the collar 22 holds the components opposite the securing nut 24.

An aperture 38 is provided in the handle 10 which aligns with an aperture 40 in the collar 22 in which an object such as a rod can be inserted to hold the shaft 14 from rotating when the nut 24 is being tightened or loosened. Preferably, the securing nut 24 is a standard 13/16 inch nut.

The materials of the components of the device 2 can be any suitable materials, with metals, such as steel, aluminum and alloys beng preferred. Resins or fiber impregnated resins can similarly be used for the components for light weight, strength and low cost. A 25 to 50 micron finish is placed on the brake surfaces of a spinning disc brake rotor by grasping the handle means 10 with one hand on each side of the drive roller 4 and placing the drive roller 4 of the device 2 against the periphery of the spinning disc brake rotor. The spinning rotor causes the drive roller 4 to turn and thereby causes the finishing discs 6, with attached finishing surfaces 8, to spin. The user then presses one of the spinning finishing surfaces 8 against the friction surface on the corresponding side of the spinning brake rotor with sufficient force to maintain significant contact until the desired finish is obtained. The user then slides the roller 4 across the periphery of the rotor until the other finishing surface 8 contacts the friction surface on the other side of the rotor with sufficient force and for a sufficient amount of time to create the desired finish thereon.

To change the abrasive discs comprising the finishing surfaces 8, the end cap 20 covering the nut 24 on the threaded end of the shaft 14 is first removed and a rod is placed through the aperture 38 in the handle 10 and in engagement with the aperture 40 on the collar 22. The securing nut 24 is removed while holding the collar 22 from rotating on the other side. The set screw 34 holding the roller 4 from rotating on the drive shaft 14 is loosened. Next, the nut 15, handle means 10, spacer **16*b* and finishing disc 6 on the side of the device 2 relating to the removed securing nut 24, and both finishing surfaces and drive roller 4 are removed. The spacer 16*a* and components beyond that are held in place by the set screws 36 in the spacer 16*a*. The components are replaced in reverse order, with new finishing surfaces 8 substituted for the used surfaces 8. The nut 24 which was removed is then tightened, again using a socket wrench on the nut 24 and a rod in the collar aperture 40 until all play in both handle means 10 is removed. The tightened nut 24 is then backed off ⅛ turn. Finally, the end caps 20** are replaced prior to use.

The maintenance required for efficient, long life of the device 2 is minimal. An occassional cleaning with a brush or an air hose is recommended to assure proper working order.

I claim:

1. A hand held finishing device for creating a non-directional finish on the friction surfaces of a rotating disc such as a disc brake rotor comprising a rotatable drive roller intermediate rotatable finishing discs, said finishing discs having finishing surfaces thereon, and handle means wherein when the drive roller engages the periphery of a spinning disc brake rotor the finishing surfaces rotate across the rotation of the friction surface.

2. The device of claim 1 further comprising a rotatable drive shaft, associated with the drive roller and finishing discs, which extends substantially the length of the device within the handle means.

3. The device of claim 2 further comprising bearing means in said handle means on which the rotatable drive shaft rotates.

4. The device of claim 3 wherein the drive shaft is from about ½ to about 1 inch in diameter and is made of a material taken from the group comprising steel, aluminum or resin.

5. The device of claim 2 further comprising a permanently attached collar means on one end of the drive shaft and threaded means on the other end, said threaded means being engaged by a securing nut to removably hold the drive shaft within the handle means and tightened to securely hold the drive roller and finishing discs in place by compression during use.

6. The device of claim 5 wherein the collar means has retention means associated with it to stop the drive shaft from rotating, for use when the nut on the other end is being loosened or tightened.

7. The device of claim 3 comprising two sets of bearing means in the handle means on each side of the roller, one set being outer bearing means in proximity to the end of the drive shaft and the other set being inner bearing means in proximity to the finishing discs.

8. The device of claim 7 further comprising spacer means between the inner bearing means and finishing discs on each side of the drive roller.

9. The device of claim 8 wherein the spacer means has an inner boss on which the finishing disc and a finishing surface are mounted.

10. The device of claim 9 wherein the boss is ⅞ inches in diameter and has a thickness less than the total thickness of the finishing disc and finishing surface.

11. The device of claim 8 wherein the spacer means has an outer boss which contacts an outer race on the inner bearing means to provide freedom of rotation of the spacer means and components therebetween.

12. The device of claim 8 wherein at least one of the spacer means has means to prohibit movement of the spacer means on the drive shaft.

13. The device of claim 12 wherein the means to prohibit movement comprises one or more set screws in the spacer means which engage the drive shaft.

14. The device of claim 5 further comprising end caps engaging the ends of the handle means to cover the ends of the drive shaft within the handle means.

15. The device of claim 1 further comprising hand shield means on said handle means in proximity to said rotatable finishing discs and drive roller.

16. The device of claim 1 wherein the drive roller is made of hard rubber and is from about 1.750 inches to about 2.500 inches in diameter and is made from material taken from the group comprising polyurethane and hard rubber.

17. The device of claim 2 wherein movement of the roller on the drive shaft is prohibited by one or more set screws mounted flush in the roller which engage the drive shaft when tightened.

18. The device of claim 1 wherein the radius of the finishing discs extending beyond the drive roller is at least equal to the width of the friction surface on the rotating disc.

19. The device of claim 1 wherein the finishing disc and finishing surface on one side of the drive roller is of a larger diameter than the finishing disc and finishing surface on the other side of the drive roller.

20. The device of claim 1 wherein the finishing surfaces are abrasive discs which rotate in cooperation with the finishing discs.

21. The device of claim 20 wherein the diameter of the finishing surfaces are at least equal to the diameter of the finishing discs.

22. The device of claim 20 wherein the abrasive discs are aluminum oxide discs having a surface of from about 24 to about 36 grit.

23. A method for creating a non-directional finish on the friction surfaces of a rotating disc brake rotor with a device having a rotatable drive roller intermediate rotatable finishing discs, said finishing discs having finishing surfaces thereon, and handle means wherein when the drive roller engages the periphery of a spinning disc brake rotor, the finishing surfaces rotate across the rotation of the friction surface, comprising the steps of holding the device by said handle means, engaging the drive roller with the periphery of the rotating disc brake rotor, moving one of the finishing surfaces into contact with the friction surface on the side of the rotor associated with that finishing surface and maintaining sufficient pressure for a sufficient period of time to create the desired finish, moving the device so that the other finishing surface contacts the other friction surface, maintaining sufficient pressure for a sufficient period of time to create the desired finish and removing the device from the rotating disc brake rotor.

* * * * *